US010603711B2

(12) United States Patent
Hoshi et al.

(10) Patent No.: US 10,603,711 B2
(45) Date of Patent: Mar. 31, 2020

(54) METHOD FOR MANUFACTURING ALLOY INGOT

(71) Applicant: DAIDO STEEL CO., LTD., Nagoya-shi (JP)

(72) Inventors: Youhei Hoshi, Shibukawa (JP); Yasuhiro Sawada, Nagoya (JP); Kenta Yamashita, Shibukawa (JP)

(73) Assignee: DAIDO STEEL CO., LTD., Nagoya-Shi, Aichi (JP)

( * ) Notice: Subject to any disclaimer, the term of this patent is extended or adjusted under 35 U.S.C. 154(b) by 277 days.

(21) Appl. No.: 15/414,222

(22) Filed: Jan. 24, 2017

(65) Prior Publication Data

US 2017/0216906 A1 Aug. 3, 2017

(30) Foreign Application Priority Data

Jan. 28, 2016 (JP) ..... 2016-014458

(51) Int. Cl.

| | |
|---|---|
| ***B21J 1/06*** | (2006.01) |
| ***C21D 8/06*** | (2006.01) |
| ***B22D 19/08*** | (2006.01) |

(52) U.S. Cl.

CPC ..... *B21J 1/06* (2013.01); *B22D 19/08* (2013.01); *C21D 8/06* (2013.01)

(58) Field of Classification Search

None

See application file for complete search history.

(56) References Cited

U.S. PATENT DOCUMENTS 3,616,842 A * 11/1971 Leghorn ..... B21B 23/00 164/459
4,281,535 A * 8/1981 Wesch, Jr. ..... G01M 3/022 138/90
4,438,644 A * 3/1984 Rut ..... B21J 9/06 29/6.01

(Continued)

FOREIGN PATENT DOCUMENTS

AU 2328877 A 9/1978
CA 2 706 040 A1 12/2010

(Continued)

OTHER PUBLICATIONS

Translation of JP 62-003842 (originally published Jan. 9, 1987) from J-Plat Pat.*

(Continued)

*Primary Examiner* — George Wyszomierski

(74) *Attorney, Agent, or Firm* — McGinn IP Law Group, PLLC

(57) ABSTRACT

The present invention relates to a method for manufacturing a round-rod shaped alloy ingot by hot forging, containing suspending a primary alloy ingot having a round-rod shape in a columnar mold while one end of the primary alloy ingot is held, pouring a molten metal formed of a heat-retaining metal into the columnar mold so as to apply a coating of the heat-retaining metal to the entire circumference of the primary alloy ingot, to obtain a forging alloy ingot, taking the forging alloy ingot out from the columnar mold, then subjecting the forging alloy ingot to a hot forging while an end portion of the forging alloy ingot is gripped as a gripping portion, and removing the coating of the heat-retaining metal.

20 Claims, 3 Drawing Sheets

(56) References Cited

U.S. PATENT DOCUMENTS

| | | | |
|---|---|---|---|
| 8,685,298 | B2 | 4/2014 | Rockenschaub et al. |
| 2004/0105774 | A1 | 6/2004 | Del Corso et al. |
| 2006/0185415 | A1 | 8/2006 | Bergue et al. |
| 2010/0308491 | A1 | 12/2010 | Rockenschaub et al. |
| 2011/0195269 | A1 | 8/2011 | Minisandram |
| 2012/0279678 | A1 | 11/2012 | Minisandram |
| 2012/0325117 | A1 | 12/2012 | Rockenschaub et al. |
| 2014/0144199 | A1 | 5/2014 | Shigihara et al. |
| 2014/0246165 | A1 | 9/2014 | Minisandram |
| 2014/0260478 | A1* | 9/2014 | Forbes Jones ..... B21J 1/02 72/47 |

FOREIGN PATENT DOCUMENTS

| | | | |
|---|---|---|---|
| CN | 1824426 | A | 8/2006 |
| CN | 106507718 | B | 7/2008 |
| CN | 101332484 | A | 12/2010 |
| CN | 103282140 | A | 9/2013 |
| CN | 103468966 | A | 12/2013 |
| CN | 104826969 | A | 8/2015 |
| CN | 106507716 | B | 3/2017 |
| EP | 2 659 993 | A1 | 11/2013 |
| JP | S51-018899 | B | 6/1976 |
| JP | S52-145340 | A | 12/1977 |
| JP | S53-103934 | A | 9/1978 |
| JP | S56-045260 | A | 4/1981 |
| JP | S61-111743 | A | 5/1986 |
| JP | S62-003842 | A | 1/1987 |
| JP | S62-286637 | A | 12/1987 |
| JP | S64-031556 | A | 2/1989 |
| JP | 2001-079633 | A | 3/2001 |

OTHER PUBLICATIONS

Extended European Search Report dated Jun. 23, 2017 in European Application No. 17152355.8.

Chinese Office Action, dated Nov. 5, 2018, in Chinese Application No. 201710054145.3 and English Translation thereof.

"锻压手册第 1 卷锻造", 中国机械工程学会 塑性工程学会, 第 173-174 页 • 机械工业出版社 • 2013 年 11 月 Partial Translation thereof.

European Office Action dated Dec. 13, 2018 in European Application No. 17152355.8.

Chinese Office Action dated Jul. 1, 2019, in Chinese Patent Application No. 201710054145.3 with an English translation.

European Office Action dated Aug. 8, 2019, in European Patent Application No. 17152355.8 with an English translation.

Notification for Reasons for Refusal dated Oct. 11, 2019 for Japanese Patent Application No. 2016-014458.

Chinese Office Action dated Dec. 12, 2019, in Chinese Patent Application No. 201710054145.3 with an English translation.

European Office Action dated Feb. 3, 2020, in corresponding European Patent Application No. 17152355.8.

* cited by examiner

METHOD FOR MANUFACTURING ALLOY INGOT

TECHNICAL FIELD

The present invention relates to a method for manufacturing an alloy ingot having a round-rod shape through hot forging, and particularly relates to a method for manufacturing an alloy ingot consisting of a hard-to-work alloy which has relatively high deformation resistance at the time of hot forging, such as an age-hardening high-alloy steel or an Ni-based or Co-based high-alloy.

BACKGROUND ART

In the method for manufacturing an alloy ingot having a round-rod shape through hot forging, the alloy ingot is heated and subjected to a forging process, and the forging process is finished before a temperature of the alloy ingot is decreased to a predetermined temperature, or the alloy ingot is reheated and repeatedly subjected to the forging process. In consideration of efficiency in the forging process, a predetermined amount of forging processing can be desirably completed by one-time heating of the alloy ingot rather than performing reheating. In this regard, a forging method in which a temperature decrease of the alloy ingot is minimized to secure a long processing time has been proposed.

For example, Patent Document 1 discloses a forging method for performing hot forging while minimizing a temperature decrease by coating an alloy ingot (a workpiece) such as an ultra heat-resistant alloy with a heat-resistant ceramic fibrous material. First, a heat-retaining sheet Ruined of a heat-resistant ceramic fibrous material is prepared and thereby is covered an outer peripheral surface of the alloy ingot. Furthermore, the heat-retaining sheet is fixed by using a stainless steel foil and a stainless steel band. Then, the resulting one is heated, and is subjected to high-speed tetrahedral forging such that a plurality of passes of a forging process are performed by one-time heating. As compared with a case where the outer peripheral surface is not coated with the heat-retaining sheet, the decreasing rate of the temperature of the alloy ingot can be made slow due to a heat retaining effect of the heat-retaining sheet, and thus a long processing time can be taken until the temperature decreases to a predetermined temperature in one-time heating, and thereby a large amount of the forging processing can be obtained. In addition, if the heat-retaining sheet is deliberately adjusted in advance such that it easily becomes damaged, it is possible to take the heat-retaining sheet off by just bringing a processing peripheral blade into contact with the heat-retaining sheet to drop it down without interfering with a finishing surface.

However, in the case of a high-alloy which has relatively high deformation resistance at the time of forging, such as an ultra heat-resistant alloy, as also disclosed in Patent Document 1, cracks are easily generated due to a temperature decrease during a forging process. The cracks generated due to the temperature decrease during the forging process of the hard-to-work alloy are easily generated not only in an alloy having relatively high deformation resistance, but also in an alloy such as an age-hardening alloy in which a precipitated phase appears at a certain temperature or lower to rapidly increase the deformation resistance. In a forging process of the aforementioned alloys, it is necessary to strictly control the forging temperature to be a predetermined temperature or higher at all times; however, in a method of simply winding the heat-retaining sheet around the alloy ingot as disclosed in Patent Document 1, since the followability of the heat-retaining sheet for the deformation of the alloy ingot is not sufficient, a gap is generated between the alloy ingot and the heat-retaining sheet or the heat-retaining sheet drops down during the forging process, and thereby it is not possible to stably retain the heat of the alloy ingot in some cases. In this regard, a method in which an alloy ingot is fitted into a tube and then subjected to a forging process has been proposed, that is, a method in which a heat-retaining member formed of metal coating is provided around an alloy ingot and the resulting one is subjected to a forging process has been proposed.

For example, Patent Document 2 discloses a "insert-casting" method in which a round-rod shaped alloy ingot formed of an age hardening Ni-based ultra heat-resistant alloy is inserted into a mold so as to stand upright on a bottom portion while not being in contact with the inner peripheral surface of the mold, and heat-retaining molten metal is poured into a gap between the alloy ingot and the mold, to thereby "insert-casting" the alloy ingot by a heat-retaining metal member. The alloy ingot taken out from the mold is heat-forged together with the heat-retaining metal member. As compared with a method of fitting an alloy ingot into a tube in a related art, the heat-retaining metal member and the alloy ingot can be sufficiently attached to each other and metals can be melted and adhered to each other, and thus it is possible to integrally forge both members with excellent followability. In addition, a stainless steel or a heat-resistant steel which has a smaller deformation resistance than that of the alloy ingot is used as the heat-retaining metal member, and a difference in deformation resistance at a forging temperature between the heat-retaining metal member and the alloy ingot is minimized to be within a predetermined range, thereby preventing the heat-retaining member is only being processed. According to the above-described method, the temperature decrease of the alloy ingot can be more reliably minimized, and thus hot forging can be performed stably and efficiently.

Patent Document 1: JP-A-2001-79633

Patent Document 2: JP-A-S62-3842

SUMMARY OF THE INVENTION

Meanwhile, a uniform forged material can be obtained by continuously performing a forging process in one direction without reheating the round-rod shaped alloy ingot. However, a heat gradient is likely to be generated in a longitudinal direction in such a continuous process, and therefore, in the case of a long alloy ingot in particular, the above-mentioned "insert-casting forging" may be considered to be used. In addition, recently, performance of the hard-to-work alloy which is subjected to the hot forging tends to be further improved, and a temperature range in which the hot forging is stably performed tends to become significantly narrower.

The present invention was made in consideration of the above described circumstances, and an object thereof is to provide a method for manufacturing an alloy ingot which has improved heat-retaining properties at the time of insert-casting forging to allow hot forging to be performed for a long period of time, and which has excellent manufacturing properties to be able to attain a predetermined amount of the forging processing with fewer process steps.

According to the present invention, there is provided a method for manufacturing a round-rod shaped alloy ingot by hot forging, containing:

suspending a primary alloy ingot having a round-rod shape in a columnar mold while one end of the primary alloy ingot is held, pouring a molten metal formed of a heat-retaining metal into the columnar mold so as to apply a coating of the heat-retaining metal to the entire circumference of the primary alloy ingot, to obtain a forging alloy ingot, taking the forging alloy ingot out from the columnar mold, then subjecting the forging alloy ingot to a hot forging while an end portion of the forging alloy ingot is gripped as a gripping portion, and removing the coating of the heat-retaining metal.

According to the present invention, the coating of the heat-retaining metal can be applied to the entire surface of the round-rod shaped primary alloy ingot, particularly, to the gripping portion in which heat is easily removed by a gripping tool and the temperature decrease is relatively fast. Therefore, it is possible to hold the primary alloy ingot at a predetermined temperature or higher for a longer period of time. For this reason, a forging process can be continuously performed in one direction without repeatedly performing a heating step, and thus a desired amount of the forging processing can be obtained with fewer process steps. In addition, the coating of the heat-retaining metal can be preferably applied to both end portions which cause complex multi-axial deformation due to the forging, and thus the primary alloy ingot is prevented from being exposed to the outside due to the damage of the coating of the heat-retaining metal through a long period of time of the hot forging. It is possible to perform hot forging on a hard-to-work alloy having a higher performance, which is sensitive to a local temperature decrease.

The present invention may further contains, after the forging alloy ingot is taken out from the columnar mold, forming the gripping portion by forging a part of the forging alloy ingot coated by the heat-retaining metal, so as to reduce a diameter thereof, and inserting the gripping portion into a center hole of a ring die, and then compressing the primary alloy ingot in an axial direction through an upsetting.

As for a compressive deforming process in the axial direction, the primary alloy ingot is compressed in an axial direction so as to increase the diameter, and then the forging ratio in the subsequent hot forging can be increased. According to this aspect of the present invention, the coating of the heat-retaining metal at an end portion of the primary alloy ingot is prevented from being deformed, and the primary alloy ingot is sufficiently forged.

In this invention, the primary alloy ingot may be formed of an age-hardening alloy, and the hot forging may be performed at 850° C. or higher.

According to this aspect of the present invention, the primary alloy ingot is held at a temperature range which is higher than an age hardening temperature, and increase of the deformation resistance of the primary alloy ingot is minimized Accordingly, it is possible to more securely prevent that only the coating of the heat-retaining metal is deformed and damaged to make the primary alloy ingot be exposed to the outside, thereby causing local temperature decrease. That is, it is possible to more securely perform the hot forging on a hard-to-work alloy having a higher performance by improving heat-retaining properties in insert-casting forging.

In this invention, the heat-retaining metal may be formed of a stainless steel.

According to this aspect of the present invention, it is possible to more reliably transfer a compressive force of the hot forging to the primary alloy ingot covered by the coating of the heat-retaining metal, without damaging the coating of the heat-retaining metal even in a relatively high temperature at the time of the hot forging. Furthermore, it is possible to apply the coating of the heat-retaining metal at relatively low cost.

In this invention, an outer diameter of the forging alloy ingot may be equal to or less than 1.3 times an outer diameter of the primary alloy ingot. According to this aspect of the present invention, it is possible to more reliably transfer the compressive force of the hot forging to the primary alloy ingot covered by the coating of the heat-retaining metal.

MODES FOR CARRYING OUT THE INVENTION

First, a method for manufacturing an alloy ingot, which is one embodiment according to the present invention, will be described based on FIG. 1, with reference to FIG. 2 to FIG. 4.

Figure 1:
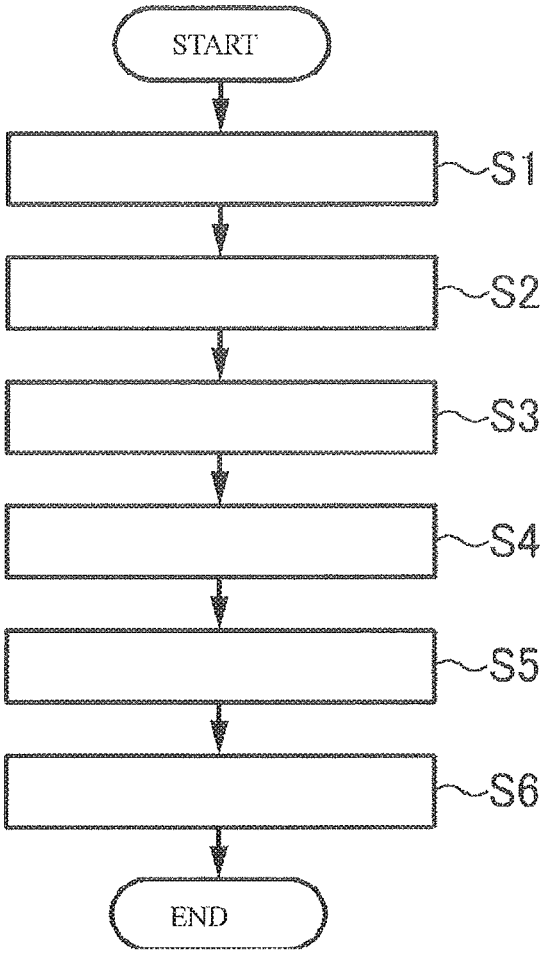
FIG. 1 is a flowchart of a method for manufacturing an alloy ingot in one embodiment of the present invention.
Figure 2:
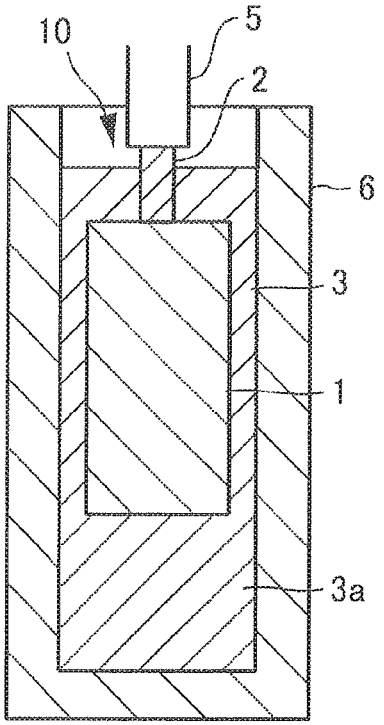
FIG. 2 is a cross-sectional view of the alloy ingot after forming a coating of a heat-retaining metal.

As illustrated in FIG. 1, first, a primary alloy ingot is manufactured (S1). In the manufacturing of the primary alloy ingot, for example, a primary alloy ingot having a round-rod shape can be obtained by using a vacuum arc remelting method (VAR). An alloy used here may be an alloy of a so-called "hard-to-work alloy" which has relatively high deformation resistance at the time of hot forging. That is, the hard-to-work alloy is an alloy in which when a temperature is decreased at the time of the hot forging, the deformation resistance becomes increased to make forging of the alloy hard, and cracks are easily generated. Examples of such a hard-to-work alloy include ultra heat-resistant alloys having a narrow forgeable temperature range, such as an Ni-based alloy, a Ti-based alloy and a Co-based alloy. Examples of the hard-to-work alloy also include an alloy such as an age-hardening alloy in which a precipitated phase appears at a certain temperature or lower to make the deformation resistance rapidly increase. Note that, this embodiment is intended to make the hot forging possible for a long period of time by minimizing the temperature decrease in the primary alloy ingot during the hot forging, and is not limited to using other alloys as the primary alloy ingot.

Next, a coating of a heat-retaining metal is formed on the entire periphery of the primary alloy ingot (S2). As illustrated in FIG. 2, the primary alloy ingot 1 is supported by a jig 5 via a suspending metal body 2 which is fixed to one end portion of the primary alloy ingot 1 and suspended in a cylindrical mold 6 having an internal space. Molten metal formed of a heat-retaining metal is poured around the primary alloy ingot 1. The molten metal is solidified to provide a coating 3 of the heat-retaining metal, applied to the entire periphery of the primary alloy ingot 1 including an outer circumference, a lower portion, and an upper portion. That is, the primary alloy ingot 1 is "insert-casted" by using the coating 3 of the heat-retaining metal. With this, the coating 3 of the heat-retaining metal can be preferably adhered to the primary alloy ingot 1. Particularly, in the coating 3 of the heat-retaining metal, an excess thickness 3*a* is imparted on the lower side (the bottom side) of the suspended primary alloy ingot 1. Note that, the mold can be formed into a square (e.g., a square, hexagonal, or octagonal cross-section).

Here, preferred examples of the heat-retaining metal include a metal which is capable of imparting a sufficient forging amount to the primary alloy ingot 1 at the time of the hot forging. That is, it is preferable to employ a metal which has lower deformation resistance in a temperature range for performing the hot forging than that of the primary alloy ingot 1, does not inhibit hot forging even when it is on the front layer side as the coating 3 and the temperature thereof is lower than that of the primary alloy ingot 1, and has high deformation resistance so as to sufficiently forge the primary alloy ingot 1. In addition, it is preferable to employ a metal which is easily thermal-treated such that embrittlement is not caused by heating or cooling at the time of hot forging. Further, it is preferable to employ a metal which has small scaling loss (loss due to the formation of an oxide film) at the time of heating, and also preferable to employ a relatively inexpensive metal. Examples of such a heat-retaining metal include a stainless steel such as SUS 304. Note that, the same materials may be used for the above-described suspending metal body 2.

After solidifying the coating 3 of the heat-retaining metal, a forging alloy ingot 10 is taken out from the mold 6, and a tong hold is formed thereon as necessary (S3).

Figure 3:
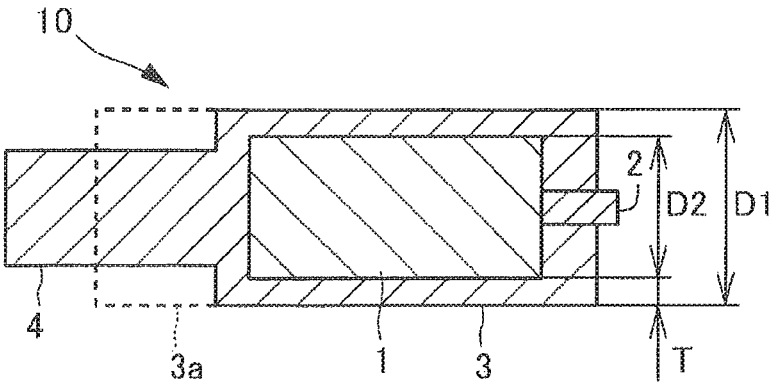
FIG. 3 is a cross-sectional view of the alloy ingot before hot forging.
Figure 4:
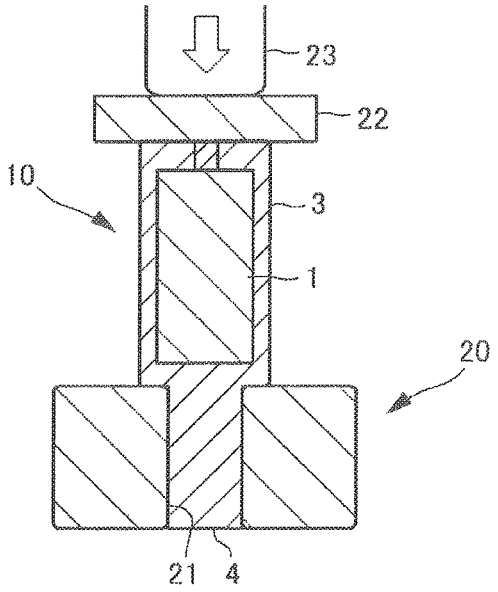
FIG. 4 is a cross-sectional view of the alloy ingot which is subjected to upsetting.

In detail, as illustrated in FIG. 3, the tong hold is formed in such a manner that a part of the excess thickness 3*a* is necked at a position separated by a predetermined distance from an end surface of the bottom side of the forging alloy ingot 10, and is extend-forging to reduce its diameter such that the tong hold is formed into a stepped shape while leaving the coating 3 of the heat-retaining metal in a predetermined thickness in the axial direction with respect to the end surface of the bottom side of the primary alloy ingot 1. With such a configuration, a tong hold 4 which is easily gripped by a gripping tool for hot forging, such as a manipulator is formed. Here, the tong hold 4 is obtained by reducing the diameter, and thus it is preferable to increase the strength by forging. Furthermore, it is preferable to appropriately manage the end portion, for example, gas cutting is preferably performed on the end portion. Note that, the suspending metal body 2 is still fixed to the primary alloy ingot 1. Here, in such a case where a diameter of the forging alloy ingot 10 is sufficiently small and thus is easily gripped by the gripping tool, the part of the excess thickness 3*a* in a state of being taken out from the mold 6 can be used as a gripping portion without forming the tong hold.

Next, the forging alloy ingot 10 is upset on a hole table as necessary (S4). That is, as illustrated in FIG. 4, the upsetting is performed in such a manner that the tong hold 4 is inserted into a center hole 21 of a ring-shaped die 20 to prevent deformation and at the same time, the forging alloy ingot 10 is compressed by a press 23 from the top side via a upper anvil 22 having a plate shape so as to be compressively deformed. The upsetting may be omitted in such a case where the forging ratio necessary for the primary alloy ingot 1 can be imparted only by the hot forging as described below.

Note that, the upsetting is typically performed before formed the tong hold; however, in the present embodiment, if the upsetting is performed before forming the tong hold, there is a concern that the sufficient compressive deforming amount cannot be imparted to the primary alloy ingot 1. That is, if the upsetting is performed before forming the tong hold, the primary alloy ingot 1 is embedded into the excess thickness 3*a* formed of the heat-retaining metal with small deformation resistance at the time of the hot forging so as to cause the excess thickness 3*a* to be greatly deformed, and thereby the deforming amount of the primary alloy ingot 1 with large deformation resistance becomes decreased. In this regard, as described above, the tong hold 4 is first formed into the stepped shape, then the upsetting on the hole table is performed by using the stepped portion so as to reduce the excess thickness 3*a* between the ring-shaped die 20 and the primary alloy ingot 1, and compressive deformation processing in the axial direction is performed so as to impart sufficient deforming amount to the primary alloy ingot 1.

In addition, the hot forging is performed (S5). In the hot forging, the tong hold 4 or the excess thickness 3*a* is gripped as a gripping portion by a gripping tool such as a manipulator, and extend-forging is performed by free forging as a so-called cantilever support. It is preferred that the hot forging be performed at 850° C. or higher.

At the time of the hot forging, the gripping tool that has a higher thermal conductivity than that of air takes heat of the forging alloy ingot 10 via the gripping portion. In contrast, in the present invention, the coating 3 of the heat-retaining metal is applied to the entire periphery of the primary alloy ingot 1, particularly, to the gripping portion, and thus it is possible to further minimize the temperature decrease of the primary alloy ingot 1. In other words, it is possible to hold the temperature of the primary alloy ingot 1 in a forgeable temperature range for a long period of time without reheating, and thus, it is possible to obtain a predetermined amount of forging processing with less number of times of heating. In addition, in one-way forging of cantilever support, it is possible to omit a switching operation in which both ends alternately grasped, and thus the operation time can be shortened. Furthermore, in the case where the gripping portion is formed by a tong hold 4, handling becomes easier and thereby the operation time can be shortened.

Meanwhile, the gripping portion such as the tong hold is typically formed on the top side of a steel ingot by using a feeder head in many cases; however, in the present embodiment, the gripping portion is formed on the bottom side of forging alloy ingot 10 as described above. The space on the bottom side in the mold 6 provided when the primary alloy ingot 1 is suspended therein can secure a dimension necessary for the excess thickness 3*a* which corresponds to the gripping portion. Therefore, it is possible to form a gripping portion having a desired shape for minimizing the temperature decrease of the end portion on the gripping portion side of the primary alloy ingot 1. With this, at the time of forming the tong hold 4, it is also possible to neck the excess thickness 3*a* such that the coating 3 of the heat-retaining metal remains in a predetermined thickness with respect to the end surface of the bottom side of the primary alloy ingot 1 in the axial direction. Note that, it is also possible to form the excess thickness on the top side to form a gripping portion; however, the excess thickness is preferably formed on the bottom side for relatively easy control of dimension.

The end surface of the top side of primary alloy ingot 1 is also covered with the coating 3 of the heat-retaining metal, and is heat-retained during the hot forging. The temperature of the end portion of the forging alloy ingot 10 having a round-rod shape is more easily decreased than the center portion, and thus it is preferable to make the dimension of the excess thickness of the coating 3 of the heat-retaining metal on the end surface side larger than that on the outer periphery.

At last, the coating 3 of the heat-retaining metal is removed by machining or the like (S6), and thereby a forged body of the primary alloy ingot 1 is obtained.

As described above, according to the present embodiment, the coating 3 of the heat-retaining metal is applied to the entire circumference, particularly, to the gripping portion of which the temperature decrease is relatively fast, and thus it is possible to minimize the temperature decrease of the primary alloy ingot 1 during the hot forging. That is, the temperature decrease of the primary alloy ingot 1 is minimized by improving the heat-retaining properties in the insert-casting forging, and thus the hot forging is allowed for a long period of time without reheating, and a predetermined amount of the forging processing can be obtained with fewer process steps.

Furthermore, the coating 3 of the heat-retaining metal can be preferably adhered to both end portions of the primary alloy ingot 1 which may cause complex multi-axial deformation due to forging, and thus when the amount of the forging processing becomes larger by a long period of time of hot forging, the coating 3 of the heat-retaining metal can be prevented from being damaged and the primary alloy ingot 1 can be prevented from being exposed to the outside. For this reason, it also is possible to perform the same hot forging on the high-performance hard-to-work alloy which is sensitive to the local temperature decrease.

Note that, in the forging alloy ingot 10, the thickness of the coating 3 of the heat-retaining metal has a preferable range. In FIG. 3, thickness T of the coating 3 of the heat-retaining metal is defined as a value obtained by subtracting diameter D2 of the primary alloy ingot 1 from diameter D1 of the forging alloy ingot 10 and then dividing the obtained value by 2. When the heat is dissipated from the surface of the coating 3 of the heat-retaining metal into the atmosphere, the forging alloy ingot 10 causes a temperature decrease from the vicinity of the surface. Here, in the case where the value of thickness T is small, the temperature decrease of the outermost layer of the primary alloy ingot 1 becomes fast, and there is a concern in that the time for being held in a forgeable temperature range is decreased. On the other hand, in the case where the value of thickness T is large, the coating 3 of the heat-retaining metal is greatly deformed due to a difference of the deformation resistance between the primary alloy ingot 1 and the coating 3 of the heat-retaining metal, cracks are easily generated on the surface thereof, the coating 3 of the heat-retaining metal is damaged from the portion in which the crack is generated, and thereby the temperature decrease occurs locally in the primary alloy ingot 1.

In this regard, the outer diameter of the coating 3 of the heat-retaining metal, that is, a relationship between diameter D1 of the forging alloy ingot 10 and diameter D2 of the primary alloy ingot 1 was examined. Note that, an age-hardening Ni-based alloy was used as the primary alloy ingot 1, and a stainless steel (SUS 304) was used as the heat-retaining metal for the coating 3.

As shown in Table 1, regarding each of various combinations of diameter D1 and diameter D2, the forging alloy ingot 10 was obtained by the above-described method and the hot forging was performed by three heatings (heating times: three times), and then the presence or absence of the cracks generation on the coating 3 of the heat-retaining metal was evaluated and the results was recorded. That is, the case where the cracks are not found in the appearance of the coating 3 of the heat-retaining metal was recorded as "A" as an excellent state, and the case where the cracks are found was recorded as "B" as a defective state. Note that, in the hot forging, the heating temperature was set in a range of 1100° C. to 1150° C.

TABLE 1

| | D1 | D2 | T | D1/D2 | Evaluation |
|---|---|---|---|---|---|
| Test 1 | 600 | 460 | 70 | 1.3 | A |
| Test 2 | 650 | 525 | 62.5 | 1.2 | A |
| Test 3 | 650 | 550 | 50 | 1.2 | A |
| Test 4 | 600 | 400 | 100 | 1.5 | B |
| Test 5 | 700 | 485 | 107.5 | 1.4 | B |

In Tests 1 to 3 in which the ratio of D1/D2 was set to be 1.2 or 1.3, cracks were not generated. On the other hand, in Tests 4 and 5 in which the ratios of D1/D2 were set to be 1.5 and 1.4, the cracks were observed on the coating 3 of the heat-retaining metal. That is, the ratio of D1/D2 in which the cracks of the coating 3 of the heat-retaining metal are less likely to be generated is equal to or less than 1.3.

Figure 5:
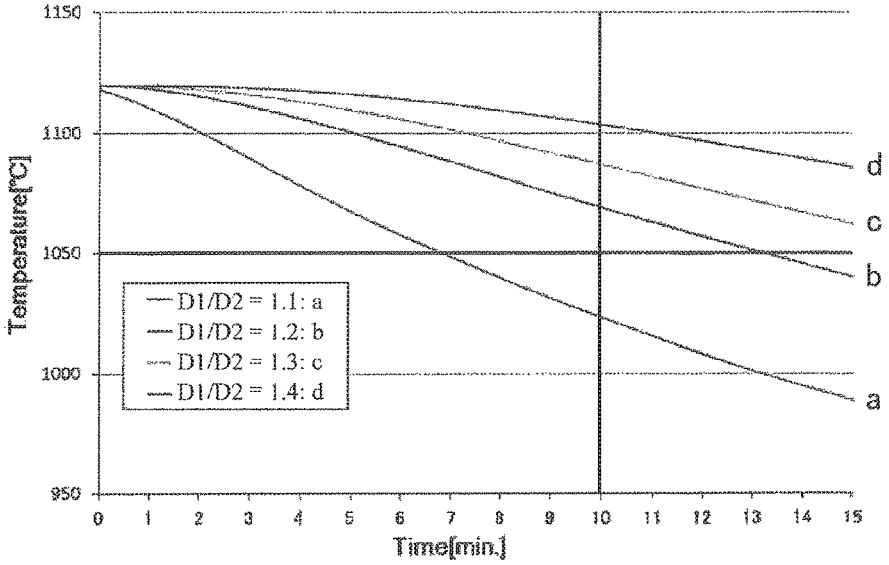
FIG. 5 is a graph illustrating a temperature change of an outermost layer of a primary alloy ingot in a simulation.

In FIG. 5, the simulation results of the temperature decrease of the outermost layer of the primary alloy ingot 1 are respectively denoted as curved lines a, b, c, and d when the ratios of D1/D2 are set to be 1.1, 1.2, 1.3, and 1.4, respectively. In the simulation, the heating temperature was set to be 1120° C., and diameter D1 was set to be 20 inches (about 500 mm). At this time, the time necessary for the forging operation provided by one heating after taken the alloy ingot out from the heating furnace is about ten minutes including a transporting time. During this ten minutes, it can be recognized that the case where the alloy ingot can be held at a temperature of 1050° C. or higher which is the forgeable temperature range is the cases of the curved lines b to d in which the ratio of D1/D2 was set to be equal to or greater than 1.2.

Based on the obtained results as described above, it is preferable that the ratio of D1/D2 is set to be 1.3 or less in order to minimize the cracks on the coating 3 of the heat-retaining metal, and it is preferable that the ratio of D1/D2 is set to be 1.2 or larger in order to minimize the temperature decrease of the primary alloy ingot 1.

As described above, the representative embodiment according to the present invention has been described; however, the present invention is not necessarily limited thereto. A variety of alternative embodiments can be found by those skilled in the art without departing from the scope of the appended claims.

The present application is based on Japanese Patent Application No. 2016-014458 filed on Jan. 28, 2016, which contents are incorporated herein by reference.

DESCRIPTION OF REFERENCE NUMERALS AND SIGNS

1 Primary alloy ingot
3 Coating of heat-retaining metal
4 Tong hold
10 Forging alloy ingot

What is claimed is:

1. A method for manufacturing a round-rod shaped alloy ingot by hot forging, comprising:

suspending a primary alloy ingot having a round-rod shape in a columnar mold while one end of the primary alloy ingot is held;

pouring a molten metal formed of a heat-retaining metal into the columnar mold so as to apply a coating of the heat-retaining metal to the entire circumference of the primary alloy ingot, to obtain a forging alloy ingot, the coating comprising an excess thickness at an end portion of the primary alloy ingot opposite the one end;

taking the forging alloy ingot out from the columnar mold;

subjecting the forging alloy ingot to a one-way hot forging while gripping the excess thickness at the end portion of the forging alloy ingot as a gripping portion; and removing the coating of the heat-retaining metal.

2. The method according to claim 1 further comprising, after the forging alloy ingot is taken out from the columnar mold:

forming the gripping portion by forging a part of the forging alloy ingot coated by the heat-retaining metal, so as to reduce a diameter thereof, and inserting the gripping portion into a center hole of a ring die, and then compressing the forging alloy ingot in an axial direction through an upsetting.

3. The method according to claim 1, wherein the primary alloy ingot is formed of an age-hardening alloy.

4. The method according to claim 3, wherein the heat-retaining metal is formed of a stainless steel.

5. The method according to claim 1, wherein the hot forging is performed at 850° C. or higher.

6. The method according to claim 1, wherein an outer diameter of the forging alloy ingot is set to be equal to or less than 1.3 times an outer diameter of the primary alloy ingot.

7. The method according to claim 1, wherein an outer diameter of the forging alloy ingot is set to be equal to or larger than 1.2 times an outer diameter of the primary alloy ingot.

8. The method according to claim 1, further comprising:

forming the primary alloy ingot by using a vacuum arc remelting process.

9. The method according to claim 1, wherein the primary alloy ingot comprises one of a Ni-based alloy, a Ti-based alloy and a Co-based alloy.

10. The method according to claim 1, wherein the suspending of the primary alloy ingot comprises supporting one end of the primary alloy ingot by a jig via a suspending metal body which is fixed to the one end of the primary alloy ingot, the suspending metal body comprising stainless steel.

11. The method according to claim 1, wherein the heat-retaining metal comprises a metal having a deformation resistance in a temperature range for performing the hot forging that is less than a deformation resistance of the primary alloy ingot in the temperature range for performing the hot forging.

12. The method according to claim 1, wherein the heat-retaining metal comprises a stainless steel.

13. The method according to claim 1, further comprising:

after the pouring of the molten metal and before the taking of the forging alloy ingot out from the columnar mold, solidifying the coating of the heat-retaining metal.

14. The method according to claim 1, wherein the coating of the heat-retaining metal is applied to a lower surface of the primary alloy ingot at a bottom portion of the columnar mold, and applied to an upper surface of the primary alloy ingot at an upper portion of the columnar mold.

15. The method according to claim 14, wherein the excess thickness comprises an excess thickness of the coating of the heat-retaining metal at the lower surface of the primary alloy ingot.

16. The method according to claim 15, wherein the pouring of the molten metal comprises pouring the molten metal into the upper portion of the columnar mold and the excess thickness of the coating of the heat-retaining metal is formed at the lower portion of the columnar mold.

17. The method according to claim 15, further comprising:

after the taking of the forging alloy ingot out from the columnar mold and before the subjecting of the forging alloy ingot to the one-way hot forging, forming a tong hold in the excess thickness of the coating of the heat-retaining metal.

18. The method according to claim 17, wherein the forming of the tong hold comprises necking a part of the excess thickness at a position separated by a predetermined distance from a bottom surface of the forging alloy ingot, so that the coating of the heat-retaining metal includes a predetermined thickness in an axial direction with respect to the lower surface of the primary alloy ingot.

19. The method according to claim 17, further comprising:

after the forming of the tong hold and before the subjecting of the forging alloy ingot to the one-way hot forging, inserting the tong hold into a center hole of a ring-shaped die, and compressing the forging alloy ingot by a press at an upper surface of the forging alloy ingot that is opposite the tong hold, via an upper anvil having a plate shape.

20. A method for manufacturing a forged body, comprising:

suspending a primary alloy ingot in a mold;

pouring a molten heat-retaining metal into an upper portion of the mold so as to apply a coating of the heat-retaining metal to the primary alloy ingot, to obtain a forging alloy ingot, the coating comprising an excess thickness at a bottom portion of the mold;

extend-forging a part of the excess thickness of the coating to form a tong hold;

subjecting the forging alloy ingot to a one-way hot forging while gripping the tong hold; and removing the coating of the heat-retaining metal to obtain the forged body of the primary alloy ingot.

* * * * *